US009290917B2

(12) United States Patent
Condon et al.

(10) Patent No.: US 9,290,917 B2
(45) Date of Patent: Mar. 22, 2016

(54) RECESSED WALL-MOUNTED OUTLET BOX WITH PUSH-PULL HANDLE ASSEMBLY

(75) Inventors: Duane R. Condon, Ramona, CA (US); Bill A. Ghiglieri, Reno, NV (US); Marshall W. Henningsen, Carson City, NV (US)

(73) Assignee: LSP Products Group, Inc., Irving, TX (US)

( * ) Notice: Subject to any disclaimer, the term of this patent is extended or adjusted under 35 U.S.C. 154(b) by 14 days.

(21) Appl. No.: 13/248,748

(22) Filed: Sep. 29, 2011

(65) Prior Publication Data

US 2013/0082201 A1 Apr. 4, 2013

(51) Int. Cl.
*E03C 1/02* (2006.01)
*E03C 1/042* (2006.01)

(52) U.S. Cl.
CPC ..... *E03C 1/021* (2013.01); *E03C 1/042* (2013.01); *Y10T 137/698* (2015.04)

(58) Field of Classification Search
CPC ..... E03C 1/021; E03C 1/042; Y10T 137/698
USPC ..... 137/359, 360, 361; 251/231, 279, 293
See application file for complete search history.

(56) References Cited

U.S. PATENT DOCUMENTS

| | | | | | |
|---|---|---|---|---|---|
| 1,377,597 | A * | 5/1921 | Mueller | 285/46 | |
| 1,389,876 | A * | 9/1921 | Keppler | 137/351 | |
| 1,585,084 | A * | 5/1926 | Cunningham | 137/361 | |
| 1,612,433 | A * | 12/1926 | Heil et al. | 137/613 | |
| 1,677,794 | A * | 7/1928 | Mueller | F16K 1/42 137/360 | |
| 2,725,894 | A * | 12/1955 | Mamoli | F16K 19/00 137/360 | |
| 5,566,708 | A * | 10/1996 | Hobbs, Jr. | 137/360 | |
| 5,983,923 | A | 11/1999 | Hobbs et al. | | |
| 6,125,881 | A | 10/2000 | Hobbs et al. | | |
| 6,234,193 | B1 * | 5/2001 | Hobbs et al. | 137/360 | |
| 6,568,654 | B1 * | 5/2003 | Michna et al. | 251/100 | |

OTHER PUBLICATIONS

Anutami Product Disclosure, Pull Stop #309, Recessed concealed angle stop, Jul. 19, 2010.*

* cited by examiner

*Primary Examiner* — Kevin Murphy
(74) *Attorney, Agent, or Firm* — Ross Barnes LLP; Monty L. Ross; Robin L. Barnes

(57) ABSTRACT

An outlet box housing a stop valve that is connected to a water supply line of a building. The outlet box enables a user to control the internally housed stop valve by axial movement of a handle assembly linked to a handle on the valve. The outlet box has a faceplate with at least one aperture through which the handle assembly and water outlet line can pass. Valve inlet shanks (or adaptors) connect the stop valve to the water supply line and allow for quick and easy replacement of the stop valve.

27 Claims, 14 Drawing Sheets

RECESSED WALL-MOUNTED OUTLET BOX WITH PUSH-PULL HANDLE ASSEMBLY

BACKGROUND OF THE INVENTION

1. Field of Invention

The present invention is directed to a recessed wall-mounted outlet box having a stop valve connected to a water supply line and a push-pull handle assembly providing convenient, instantly accessible, manual control over the flow of inlet water through the valve. An alternative embodiment wherein the valve is controlled by turning the knob or faceplate is also disclosed.

2. Description of Related Art

Many different wall-mounted outlet boxes have previously been disclosed that contain valves for and provide access to one or more water supply lines and, sometimes, drain lines for household or commercial appliances such as, for example, washing machines, ice makers, toilets, and the like. In the past the valves used in many such outlet boxes were open and closed by rotating a hand wheel at the top of the valves. More recently, quarter turn ball valves have achieved widespread use because the handles on the valves move between fully open and fully closed positions by traversing an arc of only 90 degrees or less. Such prior art water outlet boxes are disclosed, for example, in U.S. Pat. Nos. 5,983,923, 6,125,881, and 6,234,193.

SUMMARY

The present invention is a compact and aesthetically pleasing, recessed, wall-mounted outlet box with a push-pull handle assembly that controls the operation of a stop valve connected to a water supply line between fully open and fully closed positions. The outlet box comprises a housing that can be mounted to at least one stud or other frame member disposed proximally to a water supply line inside a wall, and desirably further includes a faceplate or escutcheon with apertures through which the handle assembly and water line extend, while simultaneously concealing the valve and conduit behind the faceplate for a more aesthetically pleasing appearance and also providing a means for quickly closing or opening the valve without any manual rotation of the outwardly extending portion of the handle assembly. This feature of the invention is particularly helpful to elderly, arthritic, or otherwise partially incapacitated users who may have much greater difficulty grasping and rotating a valve handle than simply pushing or pulling a knob on the handle assembly to open or close a valve. Another feature of this invention is that the valve is easily replaceable with just a screwdriver and will cause no damage to the surrounding material such as drywall.

The handle assembly of the invention desirably comprises a pull rod, which is attached to the stop valve's handle and is linked to both the valve handle and the knob in such a way that pushing the knob toward the faceplate and the wall opens the valve and permits the flow of water through it, while pulling the knob outwardly from the wall and faceplate closes the valve to shut off water flow through the valve. Alternatively, it will be appreciated that stop valves can likewise be fabricated that will block fluid flow through the valve when the knob of the handle assembly is pressed inwardly toward the faceplate and wall, and that will allow the flow of water through the valve when the knob portion of the handle assembly is pulled away from the faceplate and the wall.

The present invention can be provided or otherwise utilized with pre-installed stop valves having inlet valve shanks that are readily attachable to valve extensions having selected fittings for use with threaded hose or pipe connectors, with compression fittings or solder for attachment to copper tubing (for hot water lines), with glueable joints such as CPVC or PVC piping, or with hose barbs that are readily attachable by crimping or the like to flexible hoses such as those made of crosslinked polyethylene ("PEX") pipe, or of other flexible materials. The outlet box of the invention desirably further comprises a retaining block and retainer clip that help secure the stop valve and valve inlet shank, respectively, in place relative to the valve housing. This feature enables the valve to be easily replaced.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
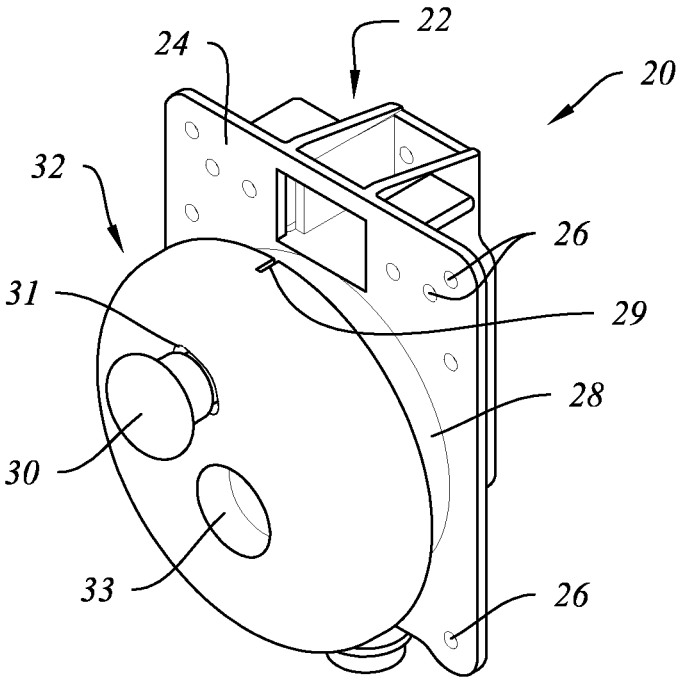
FIG. 1 is a top front perspective view of a preferred embodiment of the outlet box of the invention with the knob of the handle assembly shown in the position where the valve handle is pushed rearwardly into the "valve open" position.
Figure 2:
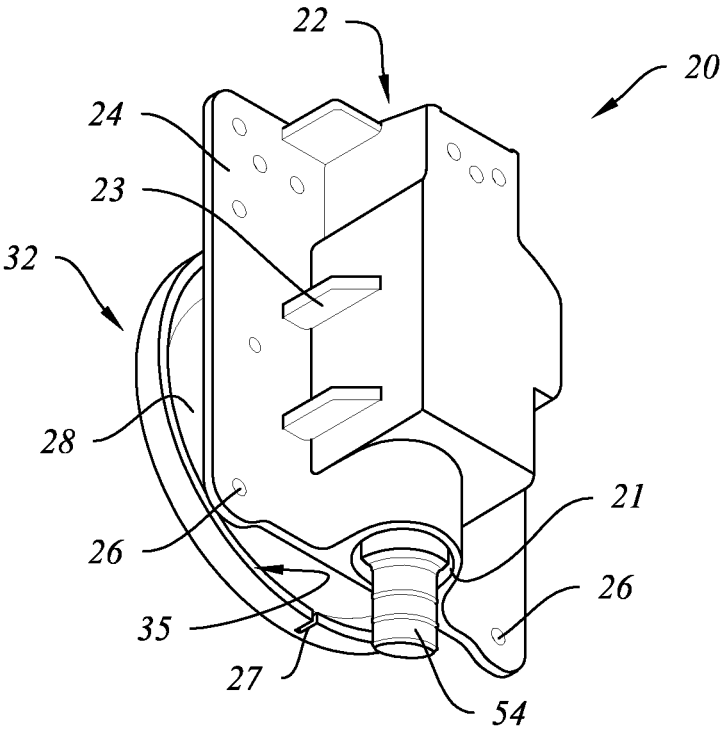
FIG. 2 is a bottom rear perspective view of the outlet box of FIG. 1.
Figure 3:
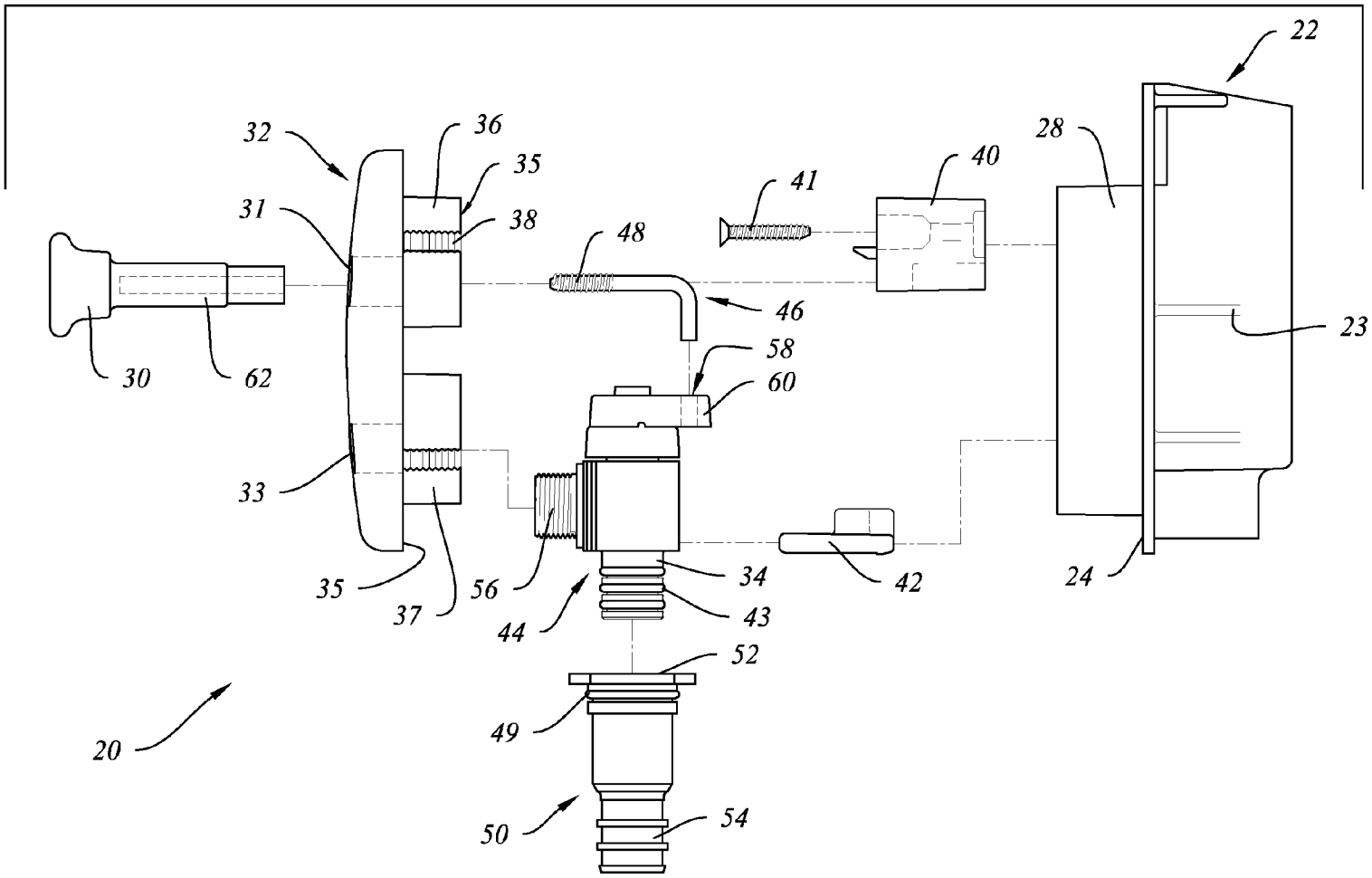
FIG. 3 is an exploded side elevation view of the outlet box of FIG. 1.
Figure 4:
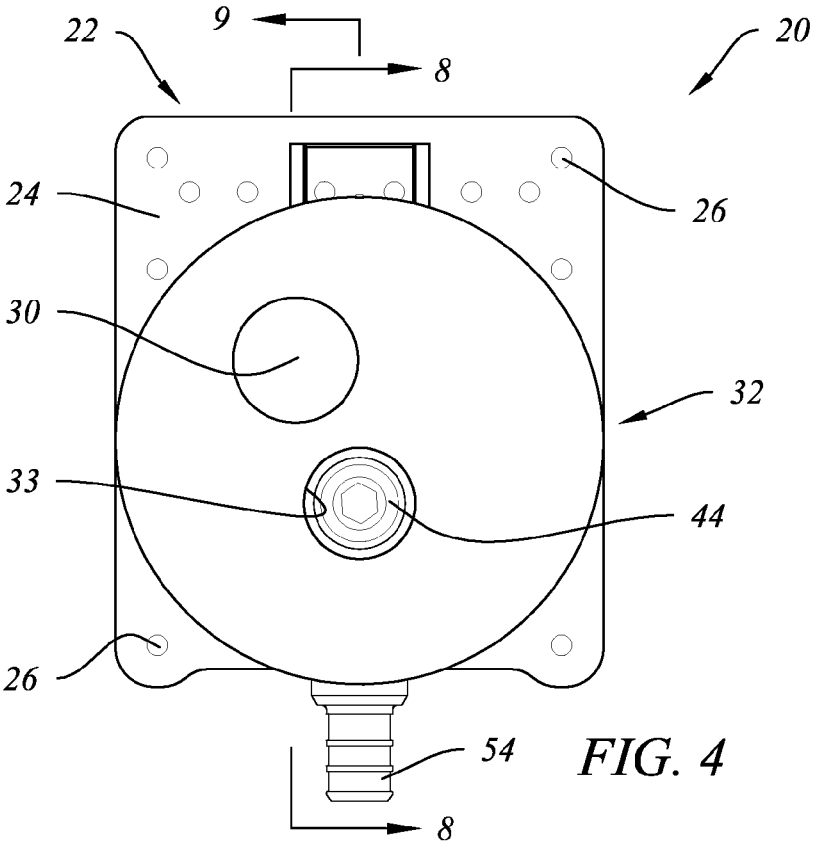
FIG. 4 is a front elevation view of the outlet box of FIG. 1.
Figure 5:
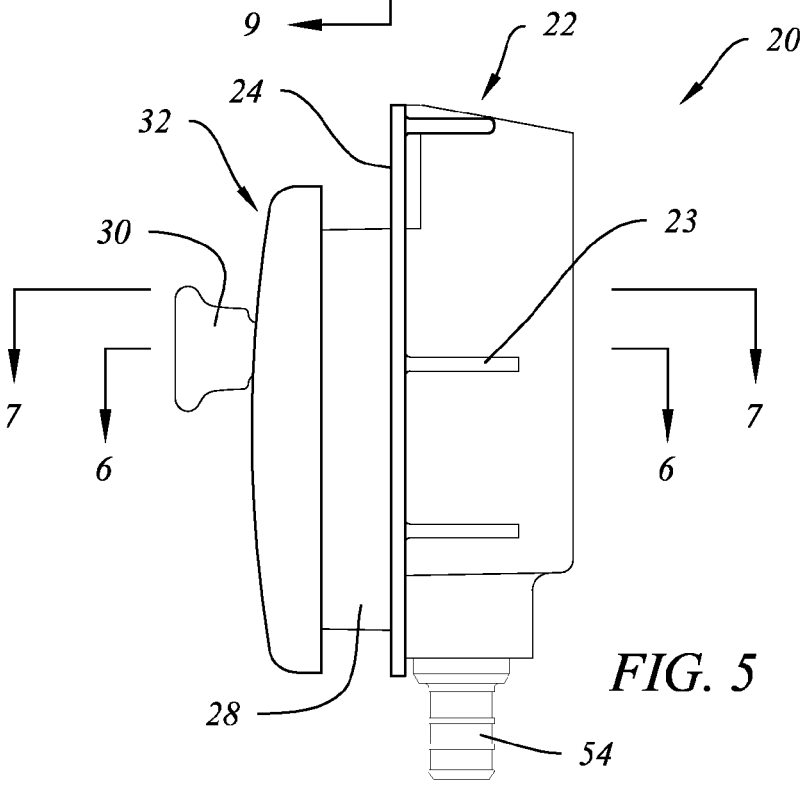
FIG. 5 is a side elevation view of the outlet box of FIG. 1.
Figure 6:
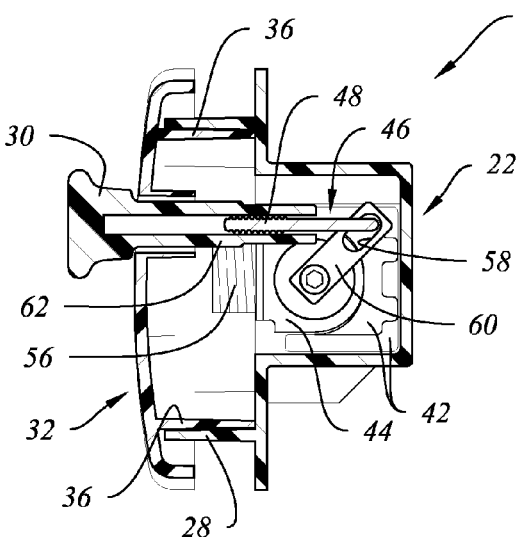
FIG. 6 is a cross-sectional top plan view taken along line 6-6 of FIG. 5.
Figure 7:
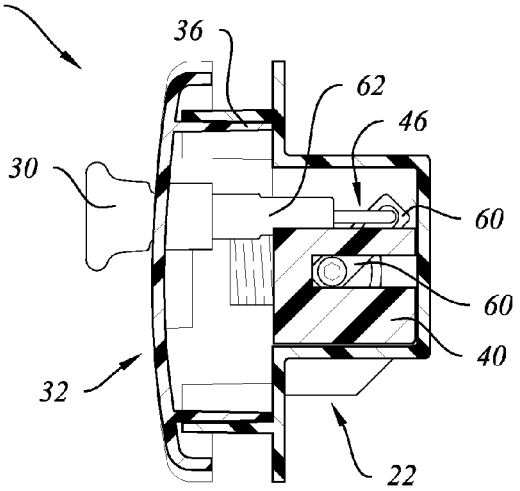
FIG. 7 is a cross-sectional top plan view taken along line 7-7 of FIG. 5.
Figure 8:
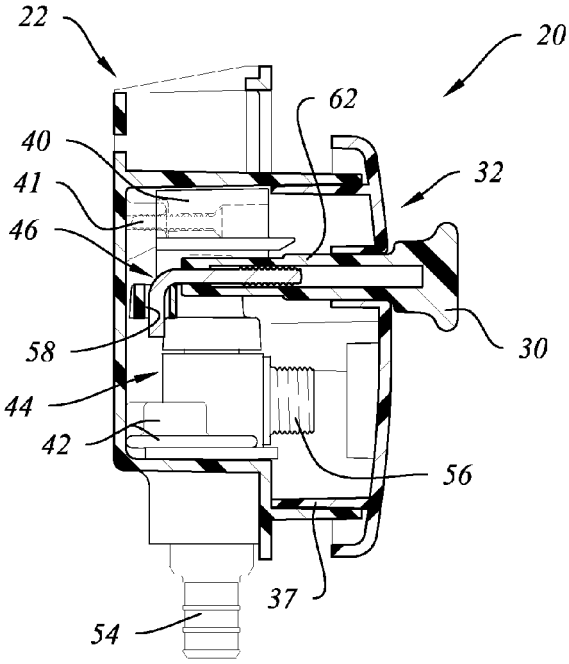
FIG. 8 is a cross-sectional side elevation view taken along line 8-8 of FIG. 4.
Figure 20:
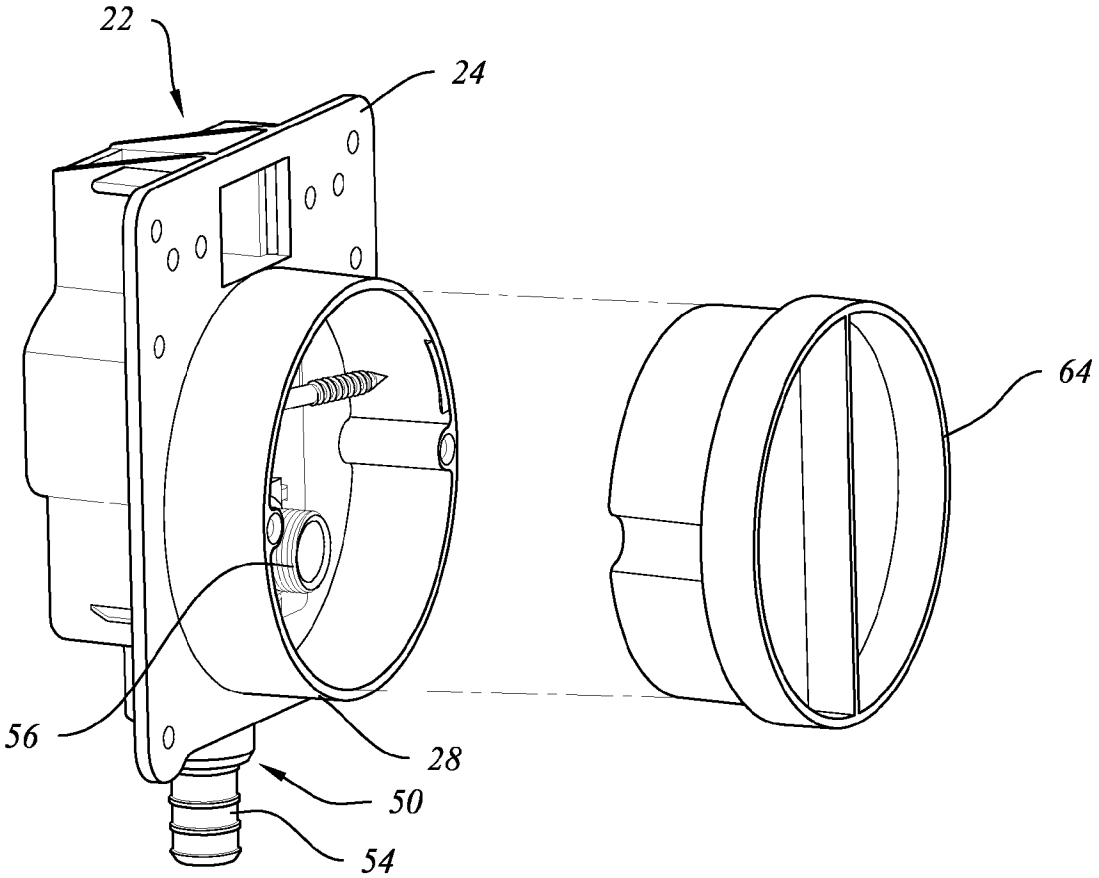
FIG. 20 is a partially exploded side perspective view of a protective cap fitting onto the outlet box with a PEX valve inlet shank installed.
Figure 21:
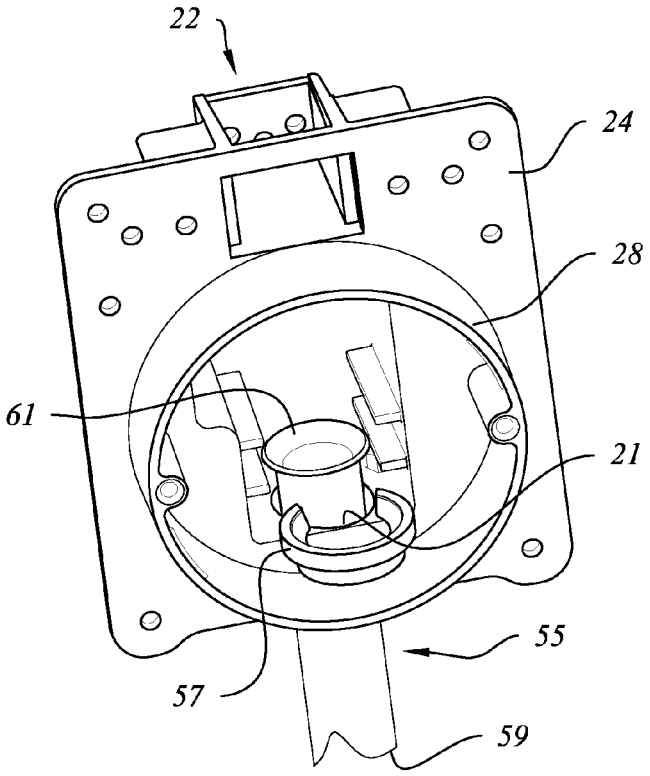
FIG. 21 is a is a top perspective view of a copper valve inlet shank and snap ring being inserted into the housing of the outlet box.
Figure 22:
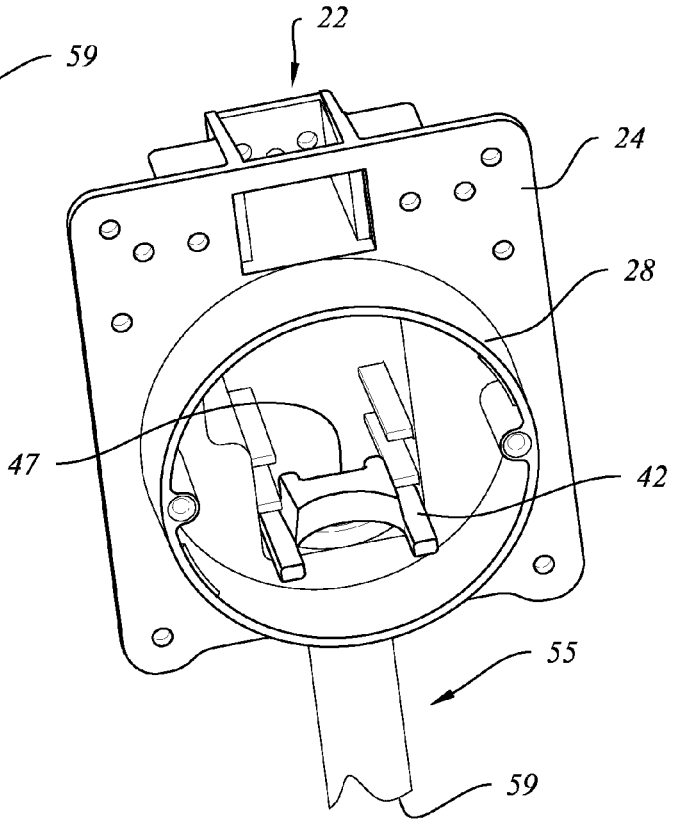
FIG. 22 is a is a top perspective view of a copper valve inlet shank being secured by a retaining clip within the housing of the outlet box.
Figure 23:
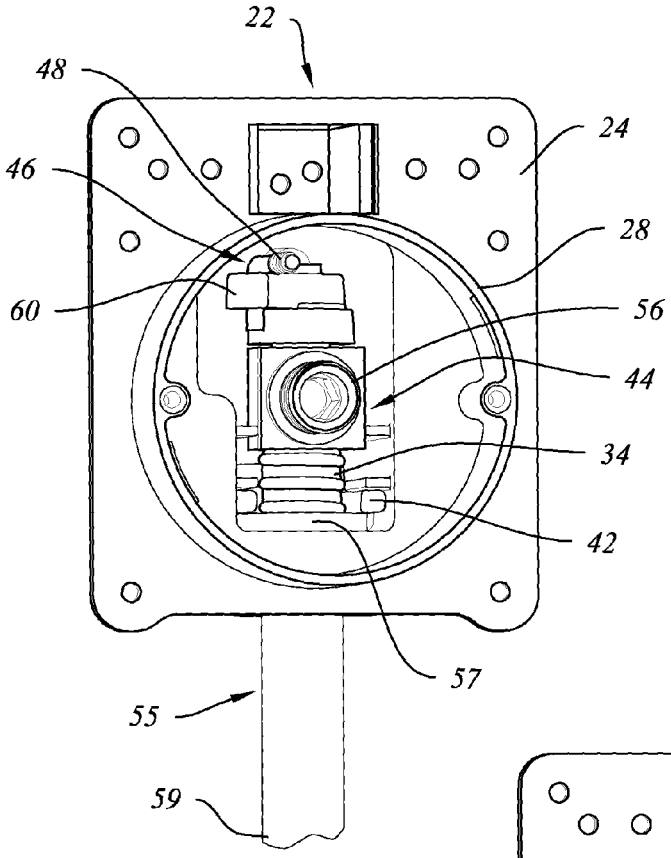
FIG. 23 is a is a top perspective view of the stop valve being inserted into a copper valve inlet shank seated within the housing of the outlet box.
Figure 24:
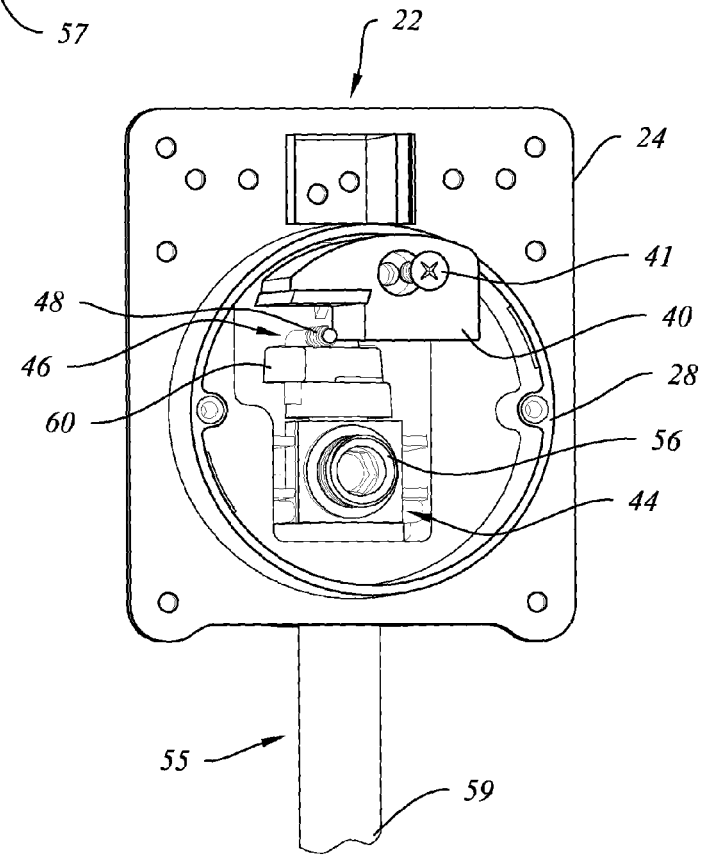
FIG. 24 is a is a top perspective view of the stop valve and copper valve inlet shank being secured by a retaining block within the housing of the outlet box.

As depicted in FIGS. 1-29, stop valve 44 is desirably mounted inside housing 22 of outlet box 20. Stop valve 44 can be any suitable stop valve, such as a quarter-turn stop valve or a push-pull gate valve. The external back side of housing 22 preferably comprises a plurality of reinforcing ribs 23. Mounting plate 24 extends perpendicularly to the opening of housing 22 and has a plurality of nail or screw holes 26 for use in attaching outlet box 20 to studs or other proximal structural members of a supporting wall. Annular collar 28 projects forwardly and supports faceplate 32 by frictional engagement or by other similarly effective conventional attachment methods. Alternatively, faceplate 32 can be attached using, for example and without limitation, screws, tamperproof screws, or the like. According to one preferred embodiment of the invention, annular collar 28 and faceplate 32 are cooperatively configured and aligned, and mounting plate 24 is sufficiently recessed from the surface of the supporting wall that rear annular edge 35 of faceplate 32 as shown in FIG. 3 sits substantially flush against the facing surface of the support wall when faceplate 32 is fully seated against and engaged with annular collar 28 of housing 22. In a preferred embodiment, rear annular edge 35 has bottom drip slot 27 and top drip slot 29. Drip slots 27 and 29 allow for the detection of a leak in stop valve 44 after installation. Drip slot 27 is located at the bottom of rear annular edge 35 for use in conventional installation, and drip slot 29 is located at the top of rear annular edge 35 for use in upside down installation. Additionally, as seen, for example, in FIGS. 20 and 26, a protective cap 64 may be provided to fit in housing 22 in place of faceplate 32 prior to installation and during the rough-in construction process to protect the valve and, for example, during shipping and transportation.

As seen, for example, in FIGS. 3, 7-9, and 13, spaced-apart arcuate top and bottom attachment members 36 and 37, respectively, are provided with outwardly facing textured sections 38 and desirably project rearwardly from faceplate 32. Arcuate top and bottom attachment members 36 and 37 are preferably sized and configured to provide frictional sliding engagement with the inwardly facing surface of annular collar 28 for the releasable attachment of faceplate 32 to housing 22 of outlet box 20.

Referring to FIGS. 14-19, valve inlet shank 50 may be designed for use in applications involving piping made of polyvinyl chloride (PVC), chlorinated polyvinyl chloride (CPVC), cross-linked polyethylene (PEX), WIRSBO PEX, or other materials. Valve inlet shank 50 acts as an adaptor for the connection of stop valve 44 to a building's water line. Valve inlet shank 50 has a distal end 54, which can either be threaded, barbed, or designed for some other type of connection or coupling, depending on the type of piping to which valve 44 is to be connected. Distal end 54 is barbed for use with PEX or WIRSBO PEX piping. The barbs for PEX would be of a different design than those for WIRSBO PEX. A standard brass crimp can be used to connect a barbed distal end 54 to a building's PEX piping. A standard WIRSBO PEX expander ring can be used to connect to the piping in the building. Glue can be used to connect distal end 54 to a building's PVC or CPVC piping. Valve inlet shank 50 is disposed within housing 22 by inserting distal end 54 down through an opening 21 of housing 22. Proximal flange opening 52 engages the interior surface of the bottom of housing 22, thereby preventing valve inlet shank 50 from slipping through opening 21. Retaining clip 42 secures inlet valve shank 50 in place and prevents it from lifting out of place during a replacement of stop valve 44.

Referring to FIGS. 21-25, valve inlet shank 55 and distal end 59 may be designed for use in applications involving copper piping. Valve inlet shank 55 acts as an adaptor for the connection of stop valve 44 to a building's water line. Valve inlet shank 55 has a distal end 59, which can be soldered with copper sweat to connect it to a building's copper piping. Valve inlet shank 55 is disposed within housing 22 by inserting proximal opening 61 from the bottom of and up through opening 21 of housing 22. Retaining ring 57 snaps under the proximal opening 61 and prevents valve inlet shank 55 from slipping through opening 21. Retaining clip 42 secures inlet valve shank 55 in place and prevents it from lifting out of place during a replacement of stop valve 44.

Figure 14:
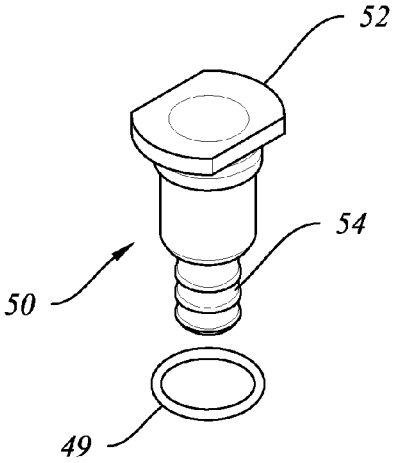
FIG. 14 is a top perspective view of a PEX valve inlet shank.
Figure 15:
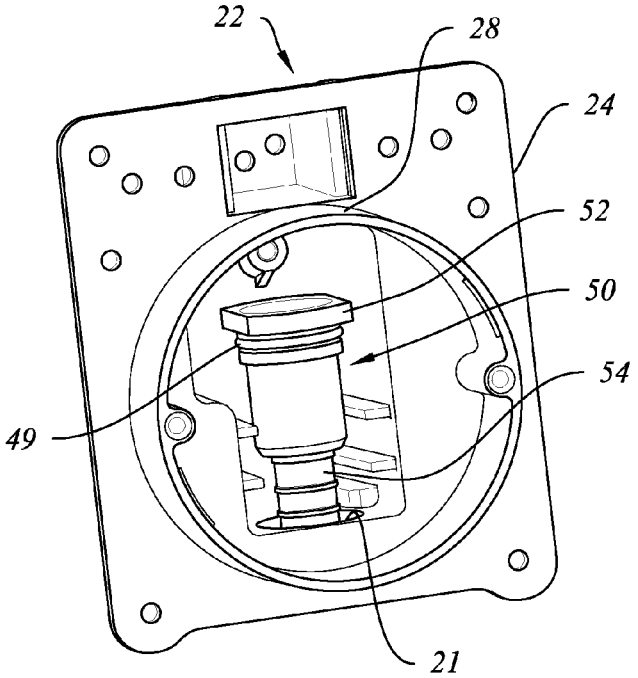
FIG. 15 is a top perspective view of a PEX valve inlet shank being inserted into the housing of the outlet box.
Figure 16:
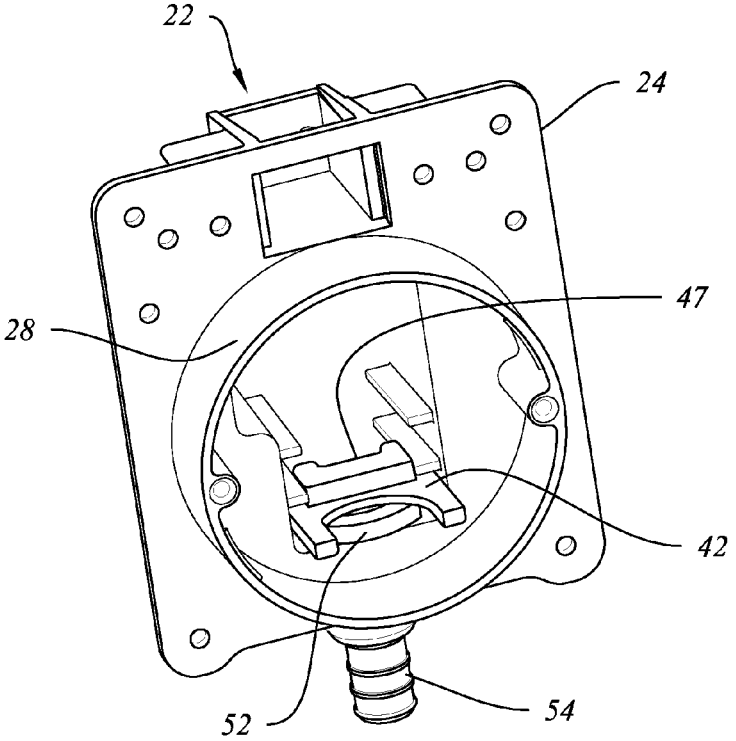
FIG. 16 is a top perspective view of a PEX valve inlet shank being secured by a retaining clip within the housing of the outlet box.
Figure 17:
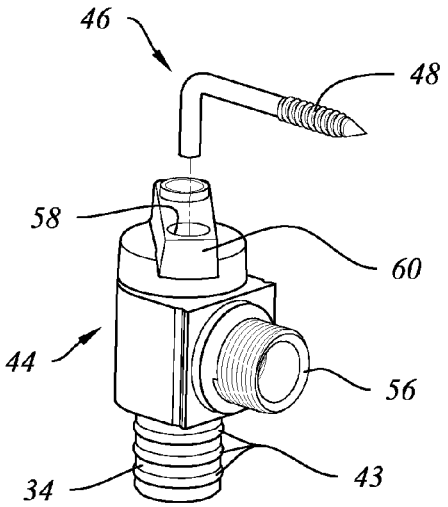
FIG. 17 is a top perspective view of the stop valve.
Figure 18:
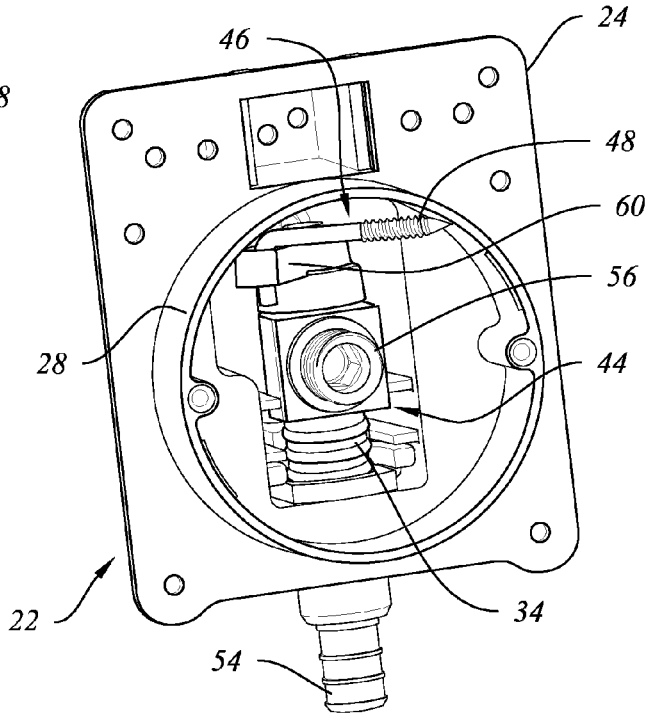
FIG. 18 is a top perspective view of the stop valve being inserted into a PEX valve inlet shank seated within the housing of the outlet box.
Figure 19:
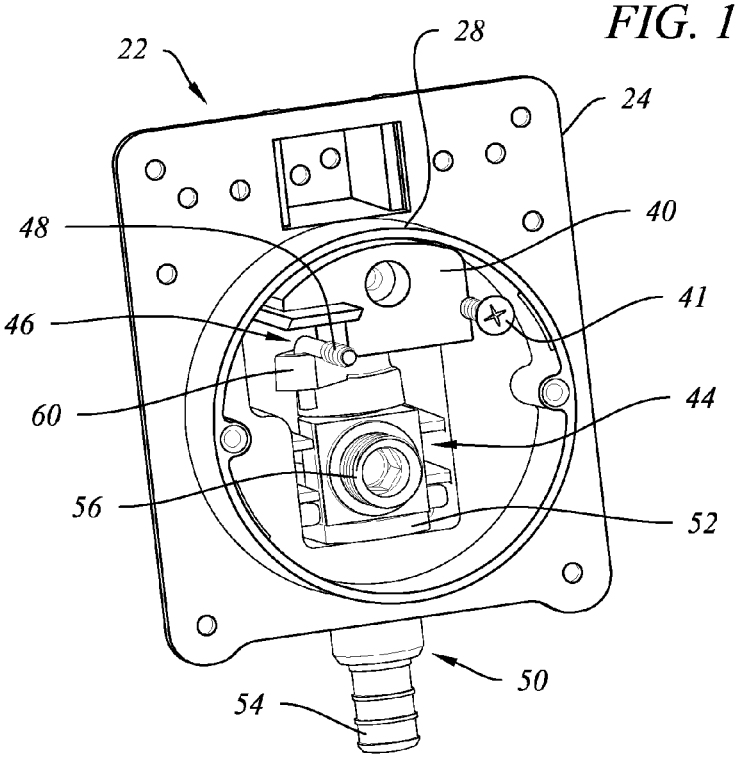
FIG. 19 is a top perspective view of the stop valve and PEX valve inlet shank being secured by a retaining block within the housing of the outlet box.
Figure 25:
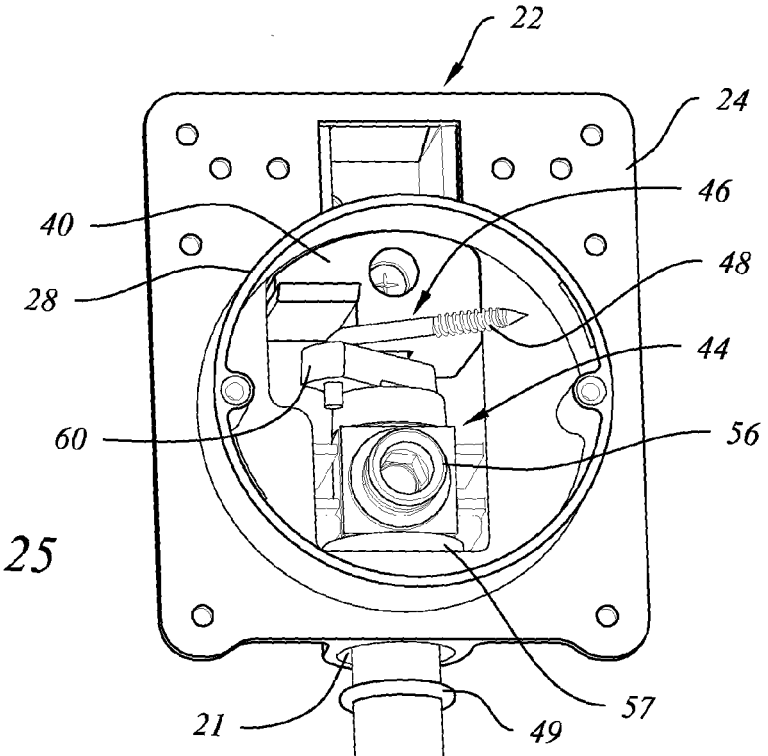
FIG. 25 is a bottom perspective view of an o-ring being attached onto the bottom of the copper valve inlet shank.
Figure 26:
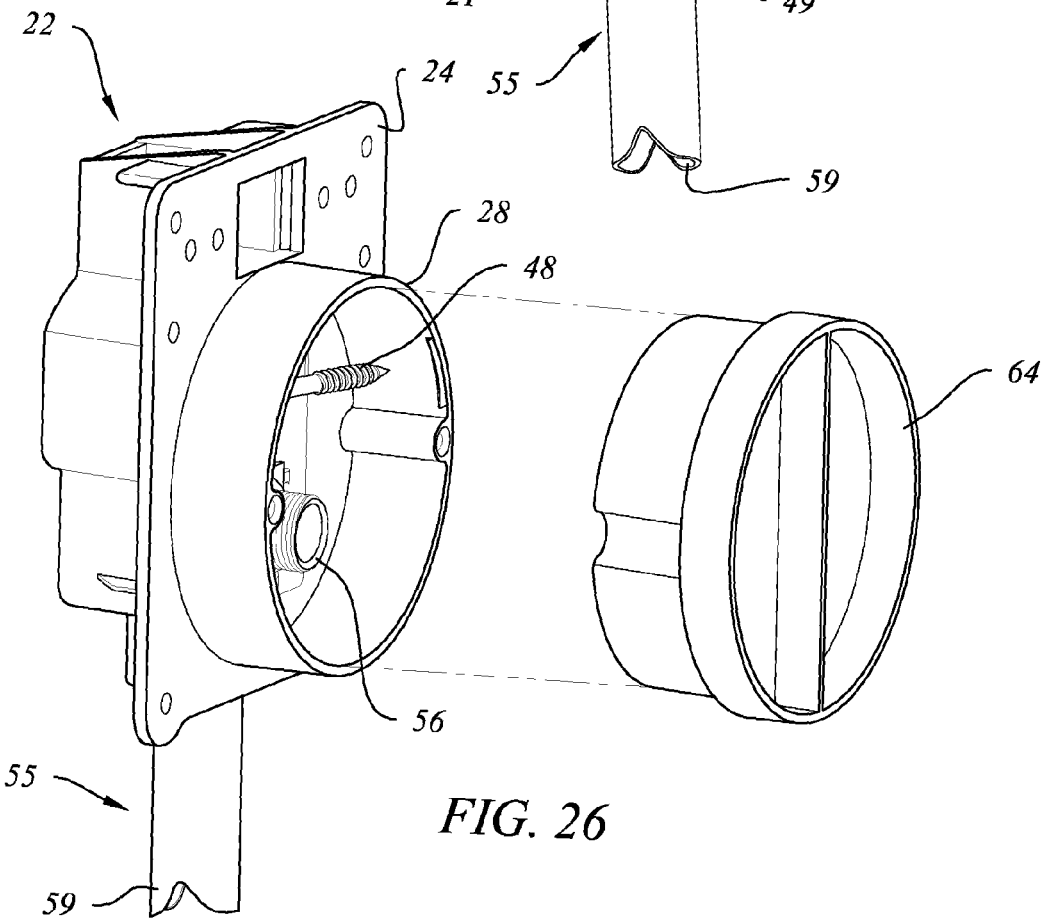
FIG. 26 is a partially exploded side perspective view of a protective cap fitting onto the outlet box with the copper valve inlet shank installed.

Stop valve 44, which is best seen in FIGS. 3, 6, 8-9, 12-13, 18-19, and 23-24, is desirably mounted through opening 21 of housing 22 by inserting its downwardly projecting valve inlet 34 into proximal flange opening 52 of valve inlet shank 50 for PEX piping applications or into proximal opening 61 of valve inlet shank 55 for copper piping applications. O-rings 43 are mounted on valve inlet 34 of stop valve 44. O-rings 43 work to seal valve inlet 34 to the interior diameter of valve inlet shank 50 or the interior diameter of valve inlet shank 55. Referring to FIGS. 14 and 25, o-ring 49 is fitted onto valve inlet shank 50 or valve inlet shank 55. O-ring 49 provides a seal between valve inlet shank 50 or valve inlet shank 55 and housing 22 at opening 21.

Referring to FIGS. 3, 6-7, and 12, valve handle 60 is disposed on top of stop valve 44 and has an aperture 58, which is a linkage that facilitates insertion of the proximal end of pull rod 46 into valve handle 60. Knob 30 is attached to extended handle 62, which passes through a first opening 31 on faceplate 32 and is attached to threaded end 48 of pull rod 46. First opening 31 and extended handle 62 can be of any shape. In a preferred embodiment, first opening 31 and extended handle 62 are square-shaped. The square shape prevents extended handle 62 from being over-threaded onto pull rod 46 during assembly or unthreaded off of pull rod 46 while the valve is in the "on" position It also ensures correct handle thread engagement to properly align handle 60 with faceplate 32 for the valve "on-off" position. Faceplate 32 desirably has a second opening 33 through which a hose or other water connector can pass for threaded engagement to valve outlet 56 of stop valve 44.

Figure 9:
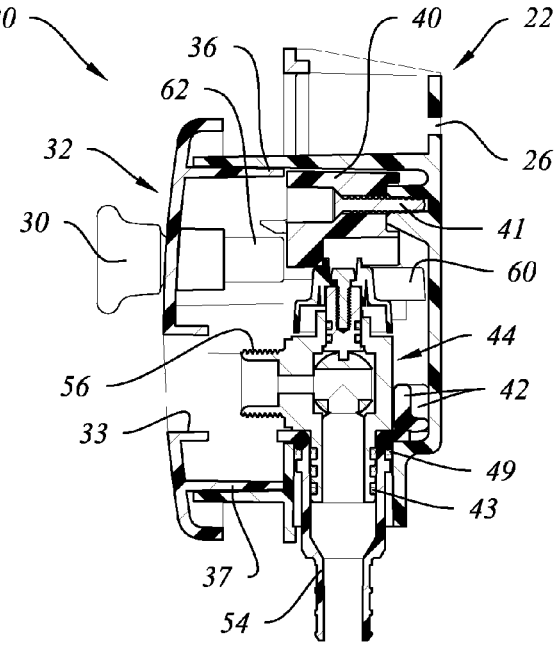
FIG. 9 is a cross-sectional side elevation view taken along line 9-9 of FIG. 4.
Figure 10:
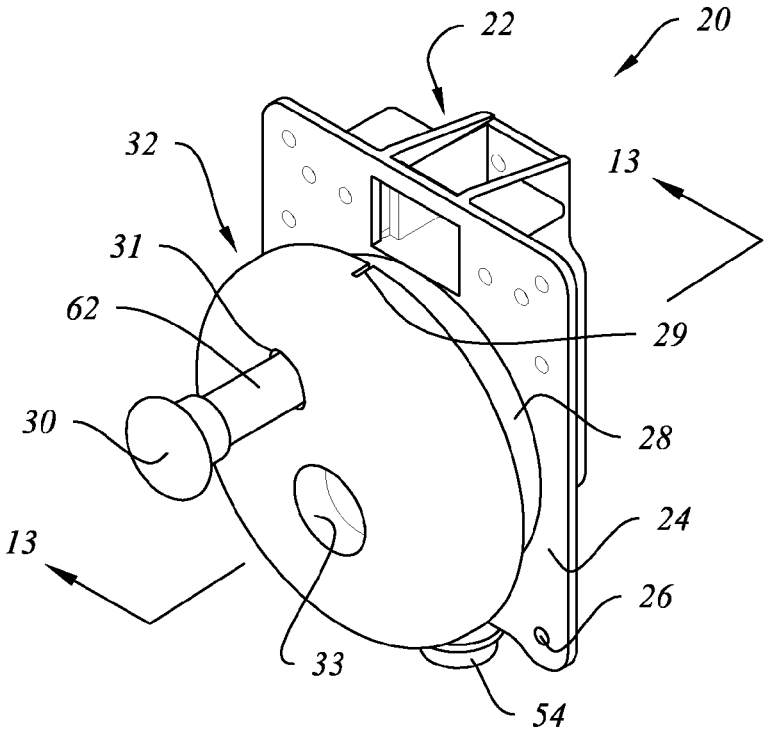
FIG. 10 is a top front perspective view of the outlet box of FIG. 1 with the knob and pull rod of the handle assembly shown in the position where the valve handle is pulled forward into the "valve closed" position.
Figure 11:
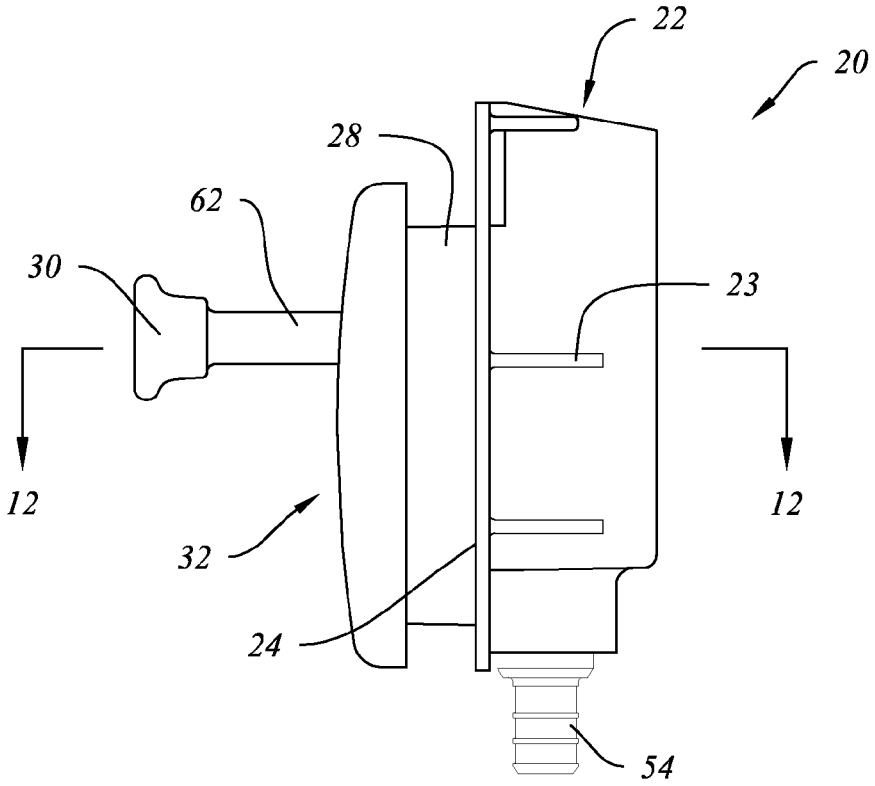
FIG. 11 is a side elevation view of the outlet box of FIG. 10.
Figure 12:
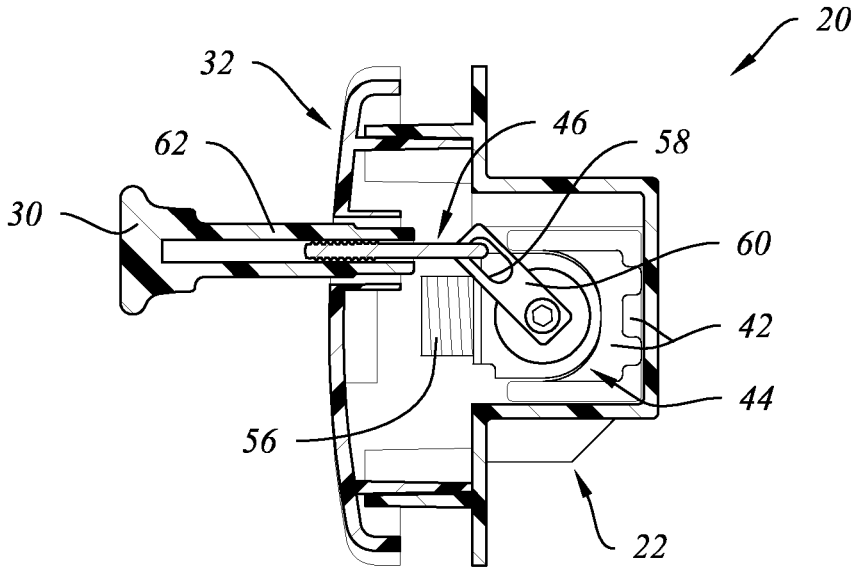
FIG. 12 is a top plan view of the outlet box of FIG. 10 taken along line 12-12 of FIG. 11.
Figure 13:
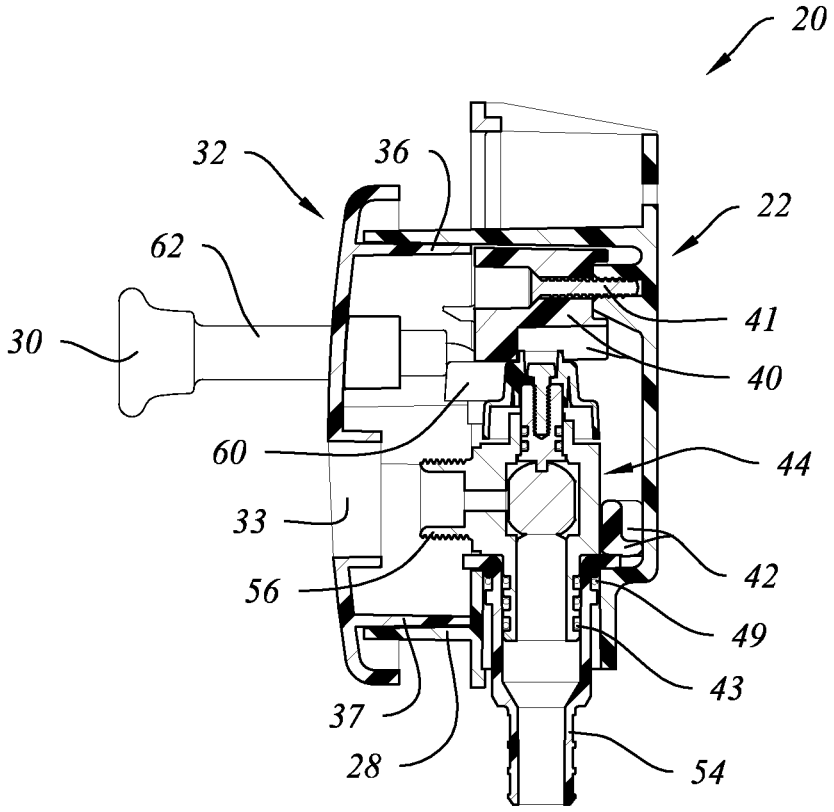
FIG. 13 is a cross-sectional side elevation view of the outlet box of FIG. 10 taken along line 13-13 of FIG. 10.

Referring, for example, to FIGS. 3 and 9, top attachment member 36 sits just outwardly of retaining block 40, which is attached to housing 22 by self-tapping screw 41 to act as a guide for pull rod 46 as it releasably engages and operates handle 60 of stop valve 44 within housing 22. As seen, for example, in FIGS. 19, 24, and 25, retaining block 40 also secures stop valve 44 in place within outlet box 20.

In an embodiment in which stop valve 44 is a quarter-turn valve, valve handle 60 opens and closes the valve with a 90 degree arc movement. Stop valve 44 can be conventionally or specially configured. In a conventional configuration, stop valve 44 is in the "open" position when looking down at stop valve 44 and valve handle 60 is clockwise 45 degrees from valve outlet 56 and in the "closed" position when valve handle 60 is 135 degrees from valve outlet 56. In a special configuration, stop valve 44 is in the "closed" position when looking down at stop valve 44 and valve handle 60 is clockwise 45 degrees from valve outlet 56 and in the "open" position when valve handle 60 is 135 degrees from valve outlet 56. In either configuration, pulling knob 30 aligns valve handle 60 with valve outlet 56, while pushing knob 30 inwardly positions valve handle 60 transverse to valve outlet 56.

A user operates stop valve 44 of outlet box 20 by pulling knob 30 to either open or close the valve and either start or stop water flow, or by pushing knob 30 to achieve the opposite result. The effect of the particular action will depend on the valve configuration as described above. FIGS. 1, 5, and 6-9 depict knob 30, extended handle 62, and pull rod 46 pushed in and the valve in the open position for a special configuration or in the closed position for a conventional configuration. FIGS. 10-13 depict the same components pulled out and the valve in the closed position for a special configuration or in the open position for a conventional configuration. Although not shown in the drawings, it will be appreciated by those of ordinary skill in the art upon reading this disclosure that an installation can be similarly configured wherein a different linkage will facilitate turning the valve off by rotating rather than pulling the handle, or even by rotating the faceplate.

For example, in a special configuration for a quarter-turn valve, when a user pulls on knob 30, extended handle 62 and pull rod 46 rotate valve handle 60 a quarter of a turn (90 degrees), thereby closing stop valve 44. When a user pushes knob 30 into outlet box 20, extended handle 62 and pull rod 46 rotate valve handle 60 a quarter of a turn in the opposite direction, thereby opening stop valve 44.

Stop valve 44 creates a watertight seal to valve inlet shanks 50 using o-rings 43. Retaining block 40 allows the valve to be installed or replaced quickly by hand or by using a simple tool, such as a screwdriver. Stop valve 44 can simply be pushed into or pulled out of an inlet valve shank after removing retaining block 40. Outlet box 20 can be mounted and connected to water lines during the construction of a building project to enable monitoring for water leaks. Should a water leak be discovered, stop valve 44 can be replaced before completion of construction such that the likelihood of wall damage after drywall installation is eliminated.

Additionally, since outlet box 20 can be installed during the rough-in phase of construction, stop valve 44 and the water line can stay pressurized during the construction of a building. This feature provides the ability to test and monitor stop valve 44 for leaks and other problems before drywall installation. Also, by installing the valve in the rough-in phase, you eliminate the need to use a copper stub out, thus reducing wasted piping by eliminating the need for using stub outs. The ability to test and monitor stop valve 44 during construction also results in the decreased likelihood of crossed or dead water lines. Crossed water lines can occur, for example, when a hot or cold water line is connected to the opposite water outlet. Even in the event of a crossed or dead water line, the present invention provides for a quick remedy because the water lines can simply be reattached to the proper outlet while still in the rough-in phase of construction. The present invention also eliminates the need for the use of a compression joint in copper piping applications. In some copper piping applications, a stop valve would be connected to a compression joint, which under pressure from the water line can sometimes cause the valve to split at the attachment point. This type of valve failure is most commonly seen in ⅝ inch valves.

Figure 27:
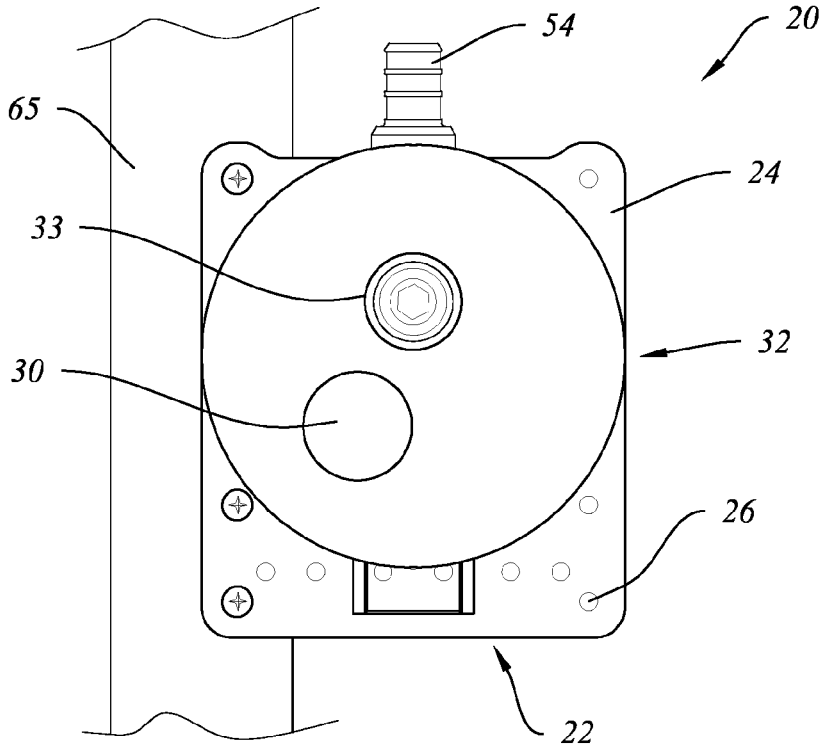
FIG. 27 is a front elevation view of an outlet box installed upside down on a stud.
Figure 28:
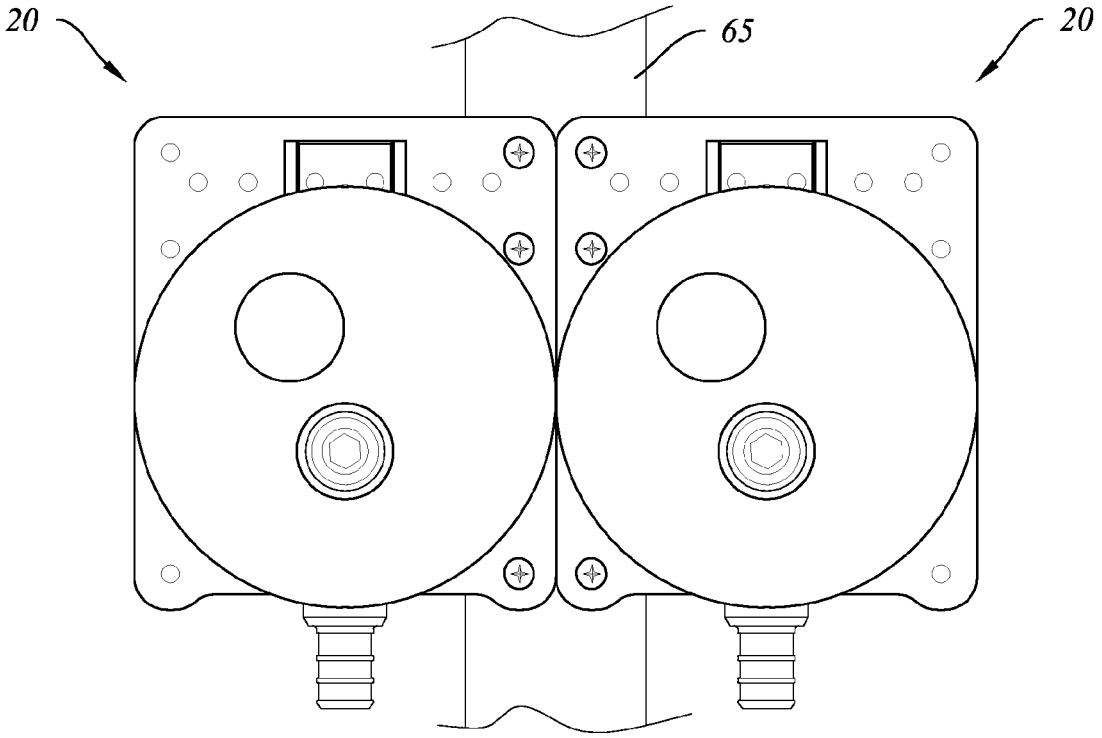
FIG. 28 is a front elevation view of two outlet boxes installed side-by-side on the same stud.
Figure 29:
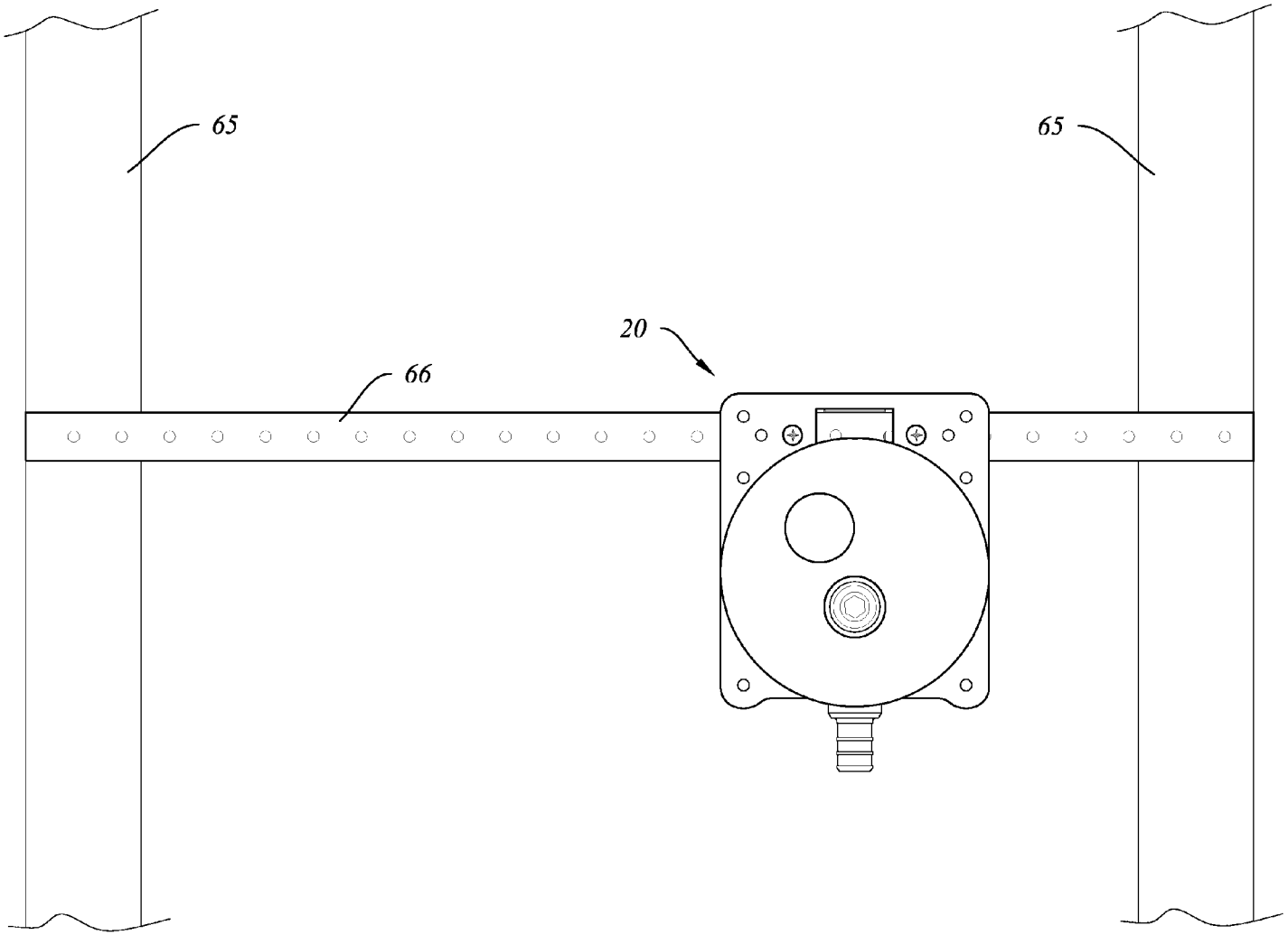
FIG. 29 is a front elevation view of an outlet box installed on a Hyco strap.

The pull stop assembly provides for simple operation of stop valve 44 by simply pulling or pushing knob 30 while faceplate 32 is in place and provides an aesthetically pleasing appearance with no piping being visible outside of the wall. Additionally, faceplate 32 and knob 30 can be painted as desired to match the building's interior walls or decor. The smaller and more compact design takes up less space under or behind toilets, sinks, or appliances. Additionally, the more compact design uses less material and provides materials cost savings in comparison to larger valve boxes. The compactness of outlet box 20 provides for several installation advantages. For example, outlet box 20 can be mounted right-side up or upside down depending on the location and orientation of the building's water lines. Outlet box 20 can also be installed on a stud 65, a block (not depicted), or a Hyco strap 66. Additionally, two outlet boxes 20 can be installed side-by-side on one standard wooden stud to accommodate two proximally located (such as hot and cold) water lines. FIG. 27 depicts outlet box 20 installed upside down on a stud 65. FIG. 28 depicts two outlet boxes 20 installed side-by-side on the same stud 65. FIG. 29 depicts outlet box 20 installed on a Hyco strap 66. Also, two outlet boxes 20 can be installed upside down and side-by-side.

The present invention can be made of plastic, metal, or any other suitable material. In particular, the valve inlet shank assembly for PEX and WIRSBO PEX piping applications can be made of a moldable polymeric material, copier, or copper alloy pursuant to ASTM standards. The valve inlet shank assembly for copper piping applications can be made of any standard copper pipe. Housing 22 and mounting plate 24 of outlet box 20 can be made of any metal or polymeric material suitable for the intended use, and preferably comprise a moldable polymeric material that is tough and resistant to cracking.

In an alternative embodiment not shown in the figures, outlet box 20 could contain two independent pull-stop assemblies. Faceplate 32 of outlet box 20 could contain two openings 33 for water connectors from an appliance that has a separate water connection for hot and cold water. In this alternative embodiment, faceplate 32 could also contain two openings 31 through which two extended handles 62 can pass to connect to two pull rods 46. A user could pull or push one or two knobs 30 to open or close one or two valves 44.

In another alternative embodiment not shown in the figures, outlet box 20 could contain two coincident pull-stop assemblies. Faceplate 32 of outlet box 20 could contain two openings 33 for water connectors from an appliance that has a separate water inlet for hot and cold water. In this alternative embodiment, however, one knob 30, one extended handle 62, and one pull rod 46 are manipulated to open or close two valves 44.

In yet another alternative embodiment not shown in the figures, faceplate 32 could contain one opening through which both the push-pull handle assembly and the water connector(s) could pass to connect to valve 44. Also alternatively, faceplate 32 could feature a cutaway section from the bottom, sides, or top through which both the push-pull handle assembly and the water connector(s) could pass to connect to valve 44.

Possible applications of the present invention include services that have a cold water connection and those that include hot and cold water connections. In particular, possible applications include toilets, faucets, vanity sinks, lavatory cabinets, pedestal sinks, kitchen sinks, icemakers, washing machines, dishwashers, water coolers, and refrigerators.

Other alterations and modifications of the invention disclosed herein will likewise become apparent to one of ordinary skill in the art upon reading this disclosure, and the inventors intend that the invention disclosed herein be limited only by the broadest interpretation of the appended claims to which they are legally entitled.

The invention claimed is:

1. An outlet box configured to control water flow between a water supply line disposed in a wall and an outlet line supplying water to an appliance or fixture external to the wall, the outlet box comprising:

a housing configured for mounting in a recess in the wall, the housing having an open front permitting access to an interior portion of the housing;

a valve inlet shank that is insertable through an opening in a wall of the housing and is configured as an adaptor for connection of the stop valve to the water supply line;

a stop valve disposed inside and attached to the housing, the stop valve having a valve handle disposed inside the housing that is rotatable inside the housing to selectively open and close the stop valve to control the water flow from the water supply line to the outlet line;

a plurality of O-rings establishing a watertight seal between the stop valve and the valve inlet shank;

a retaining block that is secured by a screw to the housing adjacent to the stop valve opposite the valve inlet shank to retain the stop valve in watertight engagement with the valve inlet shank during installation and is removable to allow the stop valve to be pulled out of the valve inlet shank for replacement of the stop valve;

a faceplate substantially concealing the stop valve inside the housing; and a single control rod linked to the valve handle and projecting outwardly through an opening in the faceplate, wherein the single control rod is axially movable and wherein axial movement of the single control rod by a user from outside the outlet box rotates the valve handle inside the outlet box to selectively open and close the stop valve.

2. The outlet box of claim 1 wherein the housing comprises a mounting plate configured to support the outlet box inside the recess disposed in the wall.

3. The outlet box of claim 1 wherein the faceplate has a rear annular edge that is substantially flush against a facing surface of the wall.

4. The outlet box of claim 1 wherein the retaining block guides the single control rod during axial movement of the single control rod by the user.

5. The outlet box of claim 1 further comprising a retaining clip securing the valve inlet shank inside the housing, the retaining clip preventing the valve inlet shank from lifting out of place during replacement of the stop valve.

6. The outlet box of claim 1 further comprising a retaining ring, wherein the retaining ring prevents the valve inlet shank from slipping through an opening in the housing during installation or replacement of the stop valve.

7. The outlet box of claim 1 wherein the valve inlet shank comprises a plurality of axially-spaced hose barbs.

8. The outlet box of claim 1 wherein the valve inlet shank has a distal end adapted to engage copper pipe.

9. The outlet box of claim 1 wherein the valve inlet shank has a distal end adapted to engage polyvinyl chloride (PVC) or chlorinated polyvinyl chloride (CPVC) pipe.

10. The outlet box of claim 1 wherein the valve inlet shank has a distal end adapted to engage cross-linked polyethylene (PEX) or WIRSBO cross-linked polyethylene (PEX) pipe.

11. The outlet box of claim 1 wherein the housing and faceplate are made of a moldable polymeric material.

12. The outlet box of claim 1 wherein the handle portion of the stop valve is disposed about 45 degrees from the outlet when the stop valve is closed.

13. The outlet box of claim 1 wherein the handle portion of the stop valve is disposed about 135 degrees from the outlet when the stop valve is open.

14. The outlet box of claim 1 wherein the outlet box comprises at least two valves, each having a single control rod.

15. The outlet box of claim 1 wherein the stop valve is replaceable from inside the outlet box without damaging the wall.

16. The outlet box of claim 1 wherein the faceplate comprises a rear annular edge having at least one drip slot.

17. The outlet box of claim 1 comprising a mounting plate that is attachable to a stud in the wall.

18. The outlet box of claim 1 comprising a strap that is attachable to at least one stud in the wall.

19. The outlet box of claim 1, further comprising a protective cap that is attachable to the housing in place of the faceplate prior to installation and during rough-in of the outlet box.

20. The outlet box of claim 1 wherein the outlet box is selectively mounted with the valve inlet facing either up or down.

21. The outlet box of claim 1 wherein the outlet line supplies water to an appliance or fixture selected from the group consisting of toilets, faucets, vanity sinks, lavatory cabinets, pedestal sinks, kitchen sinks, icemakers, washing machines, dishwashers, water coolers, and refrigerators.

22. The outlet box of claim 1, further comprising a protective cap that is attachable to the housing in place of the faceplate prior to installation and during rough-in of the outlet box.

23. An outlet box configured to be mounted inside a building wall and connected to a water supply line disposed inside the building wall to control water flow to a fixture or appliance, the box comprising:

a housing having top, bottom and opposed side walls, and an open front portion;

a quarter-turn stop valve disposed inside the housing, the stop valve having a downwardly facing water inlet port, a forwardly facing .water outlet port, and fully open and fully closed positions;

a push-pull handle assembly comprising a single rod that is selectively pushed or pulled by a user to control operation of the stop valve between the fully open and fully closed positions and a knob connected to the single rod, which knob can be pushed or pulled by the user; and a removable faceplate substantially covering the open front portion of the housing;

wherein the bottom wall comprises an opening for a water inlet through which fluid communication is established between the water supply line and the downwardly facing water inlet port of the stop valve; and wherein the removable faceplate comprises at least one opening through which fluid communication is established between the forwardly facing water outlet port of the stop valve and the fixture or appliance and through which the single rod is operated by the user to fully open or fully close the stop valve.

24. An outlet box configured to be mounted inside a building wall and connected to a water supply line disposed inside the building wall to control water flow to a fixture or appliance, the box comprising:

a housing having top, bottom and opposed side walls, and an open front portion;

a quarter-turn stop valve disposed inside the housing, the stop valve having a downwardly facing water inlet port, a forwardly facing water outlet port, and fully open and fully closed positions;

a push-pull handle assembly comprising a single rod that is selectively pushed or pulled by a user to control operation of the stop valve between the fully open and fully closed positions and a knob connected to the single rod, which knob can be pushed or pulled by the user; and a removable faceplate substantially covering the open front portion of the housing, wherein the knob and faceplate are removable and paintable as desired;

wherein the bottom wall comprises an opening for a water inlet through which fluid communication is established between the water supply line and the downwardly facing water inlet port of the stop valve; and wherein the removable faceplate comprises at least one opening through which fluid communication is established between the forwardly facing water outlet port of the stop valve and the fixture or appliance and through which the single rod is operated by the user to fully open or fully close the stop valve.

25. In an outlet box configured to be mounted inside a building wall and comprising an outlet box housing and a quarter-turn stop valve configured to be connected to a copper water supply line disposed inside the building wall to control water flow to a fixture or appliance, the improvements comprising:

a valve inlet shank having a proximal open end configured to be insertable upwardly through an opening in a wall of the outlet box housing and a distal end attachable to the copper water supply line, said proximal end being attachable to the stop valve to place the stop valve in selective fluid communication with the copper water supply line;

a retaining ring configured to snap around the valve inlet shank under the open proximal end to prevent the valve inlet shank from slipping downwardly through the opening in the wall of the outlet box when not attached to the stop valve;

a push-pull handle assembly attachable to the stop valve and comprising a single rod that is selectively pushed or pulled by a user to control operation of the stop valve between the fully open and fully closed positions; and a removable faceplate through which the rod extends and through which a water outlet line is attachable to the stop valve.

26. In an outlet box having a housing configured to be mounted inside a building wall and connected to a water supply line disposed inside the building wall to control water flow to a fixture or appliance, the improvements comprising:

a quarter-turn stop valve that is releasably insertable into a valve inlet shank that is insertable through an opening in a wall of the housing and is configured as an adaptor for connection of the stop valve to the water supply line;

a plurality of O-rings establishing a watertight seal between the stop valve and the valve inlet shank;

a retaining block that is threadedly secured to the housing adjacent to the stop valve opposite the valve inlet shank to retain the stop valve in watertight engagement with the valve inlet shank during installation and is removable to allow the stop valve to be pulled out of the valve inlet shank for replacement of the stop valve;

a push-pull handle assembly attachable to the stop valve, the push-pull handle assembly comprising a single rod that is selectively pushed or pulled by a user to control operation of the stop valve between the fully open and fully closed positions;

a removable faceplate through which the rod extends and through which a water outlet line is attachable to the stop valve; and a knob attached to a proximal end of the rod outwardly of the faceplate.

27. In an outlet box having a housing configured to be mounted inside a building wall and connected to a water supply line disposed inside the building wall to control water flow to a fixture or appliance, the improvements comprising:

a quarter-turn stop valve that is releasably insertable into a valve inlet shank that is insertable through an opening in a wall of the housing and is configured as an adaptor for connection of the stop valve to the water supply line;

a plurality of O-rings establishing a watertight seal between the stop valve and the valve inlet shank;

a retaining block that is threadedly secured to the housing adjacent to the stop valve opposite the valve inlet shank to retain the stop valve in watertight engagement with the valve inlet shank during installation and is removable to allow the stop valve to be pulled out of the valve inlet shank for replacement of the stop valve;

further comprising a push-pull handle assembly attachable to the stop valve, the push-pull handle assembly comprising a single rod that is selectively pushed or pulled by a user to control operation of the stop valve between the fully open and fully closed positions;

a removable faceplate through which the rod extends and through which a water outlet line is attachable to the stop valve; and a knob attached to a proximal end of the rod outwardly of the faceplate, wherein the faceplate and knob are paintable.

* * * * *